US005785212A

United States Patent [19]

Steiger

[11] Patent Number: 5,785,212

[45] Date of Patent: Jul. 28, 1998

[54] PLASTIC DISPENSE TAP FOR LIQUID BULK CONTAINERS

[76] Inventor: Arthur Steiger, Alte Bergstrasse 168, CH-8707 Uetikon am See, Switzerland

[21] Appl. No.: 689,802

[22] Filed: Aug. 14, 1996

[30] Foreign Application Priority Data

Jun. 14, 1996 [CH] Switzerland ..... 1495/96

[51] Int. Cl.[6] ..... B67D 3/00

[52] U.S. Cl. ..... 222/509; 222/518

[58] Field of Search ..... 222/182, 213, 222/509, 510, 518, 541.5, 541.6, 541.9

[56] References Cited

U.S. PATENT DOCUMENTS

| | | | |
|---|---|---|---|
| 2,543,850 | 3/1951 | Henricson | 222/518 |
| 3,087,656 | 4/1963 | Dougherty | 222/213 X |
| 3,107,035 | 10/1963 | Cholet | 222/518 X |
| 3,151,787 | 10/1964 | Miller | 222/518 |
| 3,158,183 | 11/1964 | Brown et al. | 222/213 X |
| 3,356,267 | 12/1967 | Scholle | 222/213 |
| 3,542,257 | 11/1970 | Parish | 222/518 X |
| 3,595,445 | 7/1971 | Buford | 222/213 |
| 4,440,316 | 4/1984 | Christine | 222/518 X |
| 4,452,425 | 6/1984 | Lucking | 222/518 X |
| 4,471,807 | 9/1984 | Lucking et al. | 222/509 X |
| 4,693,400 | 9/1987 | Frahm et al. | 222/518 |
| 5,337,775 | 8/1994 | Lane et al. | 222/509 X |

FOREIGN PATENT DOCUMENTS

| | | |
|---|---|---|
| 0 117 619 | 9/1984 | European Pat. Off. . |
| 0 350 243 | 1/1990 | European Pat. Off. . |
| 0 432 070 B1 | 6/1991 | European Pat. Off. . |
| 0 467 530 A2 | 1/1992 | European Pat. Off. . |
| 0 553 956 A1 | 8/1993 | European Pat. Off. . |
| 3212232 A1 | 10/1982 | Germany . |
| 1 471 039 | 4/1977 | United Kingdom . |
| 39 10425 | 10/1990 | United Kingdom . |
| 2 247 882 | 3/1992 | United Kingdom . |
| 2 283 077 | 4/1995 | United Kingdom . |
| 90/05696 | 5/1990 | WIPO . |
| WO 94/29214 | 12/1994 | WIPO . |
| 95/22504 | 8/1995 | WIPO . |

*Primary Examiner*—Kenneth Bomberg
*Attorney, Agent, or Firm*—Ratner & Prestia

[57] ABSTRACT

The proposed tap features a hollow, elastic body (1) with an inlet opening and an outlet opening (4). In addition, it features a valve element (7) which in its basic position closes off the outlet opening (4). In the tap of the first embodiment, the lift causing the valve element to be pulled out of the outlet opening (4) is achieved by the body (1) being deformed by the application of pressure at the side. In the second embodiment of the tap, the lift causing the valve element to be thrust out of the outlet opening is achieved by deforming the body by applying pressure from above and below. The valve element (7) is connected to the wall (5) of the tap body (1) by of a rod-shaped stem (10). The corresponding mounting position of the valve element is located across from the center of the outlet opening (4).

5 Claims, 5 Drawing Sheets

PLASTIC DISPENSE TAP FOR LIQUID BULK CONTAINERS

FIELD OF THE INVENTION

The invention pertains to a plastic dispense tap in accordance with the precharacterizing clause of.

BACKGROUND OF THE INVENTION

Bulk containers which are comprised of a rigid outer container and a flexible inner container are increasingly coming to be used to package liquid foodstuffs and beverages like wine, edible oils etc. The rigid outer container can be cube- or right-parallelepiped-shaped and made of corrugated board. The flexible inner container can be bag-like and be made of thermowelded plastic film. Containers of this kind are also referred to as bag-in-box containers. The sack-like inner container features a round opening for the purpose of removing liquid from the container. There is normally a coupling piece in this opening for mounting a tap, the coupling piece being essentially shaped as a hollow cylinder. The coupling piece is welded to the plastic film of the container in a liquid- and gas-tight manner. Welding plastic film is also referred to as heat-sealing in engineering circles. In order to obtain a resilient weld joint or heat-seal between the film and the coupling piece, the coupling piece also features a thin, wide laterally protruding flange at one of its ends. This flange is normally made of low-density flexible plastic. Heat-sealing takes considerably less longer for a flange made of flexible plastic as compared with a flange made of rigid plastic. In addition, a thin flange made of flexible plastic is extremely pliable, consequently enabling it to accommodate the folds and bulges of the full inner container for the most part. This prevents the plastic film of the inner container from ripping along the outer diameter of the flange for the most part. Usually a spigot or tap is pressed into this coupling piece. Such a tap essentially features a hollow body with an inlet and outlet opening. The flow of liquid from the inlet opening through the body to the outlet opening can be regulated by a valve device.

When the liquid bulk container is closed, the tap is stored inside the rigid outer container. The wall of the outer container is perforated at the position behind which the tap is located. The container is opened by simply pressing in this perforated place. The tap can then be pulled out of the container. In the process, however, the actuating element of the tap might be inadvertently pressed, the result being that liquid unintentionally flows out. Consequently, it is advantageous when the tap features an additional securing mechanism (seal) which causes the tap to be fixed in place and which has to be removed before using the tap for the first time.

Liquid cannot flow out of rigid containers unless air is able to flow in at the same time. The considerable disadvantage posed by this is that the liquid inside the container comes into contact with this inflowing air, thus causing the liquid to additionally oxidize. This is not a problem when it comes to bag-in-box containers. The inner container of a bag-in-box is flexible, it collapsing when liquid is removed from it by virtue of the gravity acting on it. The volume of the inner container continuously adapts to the decreasing volume of liquid, meaning that air does not flow into the container to replace the liquid flowing out of it. Additional oxidation of the liquid can thus be prevented.

An optimal tap should have the following characteristics:

One very important characteristic of an optimal tap is that it be oxygen-tight. When oxygen is able to seep into the liquid bulk container, it impairs the shelf life of the liquid foodstuff or makes it more perishable. This applies particularly to liquid foodstuffs and beverages which are highly susceptible to oxidation when coming into contact with the oxygen in the air. An example of this is wine.

Taps are normally made of plastic. As a consequence, the surfaces of the tap components are never completely smooth. In addition, dust particles inevitably cling to or collect on the surfaces of the tap. The rough surfaces and the dust particles result in the sealing surfaces of the tap not forming a perfect seal. The more joints or sealing surfaces a tap has, the more likely that it will form less and less of a perfect seal.

Since bag-in-box containers and accordingly their taps are made to be used once, it is important that the taps be capable of being manufactured as cost effectively as possible. Low manufacturing costs can be achieved when as little plastic as possible is used in the manufacture of a tap and the tap is comprised of as few and as simple-to-mold pieces as possible. The form and the design of the individual components should enable mass production using multi-impression molds. Such a multi-impression mold contains numerous (e.g. 30) impressions or cavities for each individual component.

An optimal tap should also provide for the following:

a) It should enable a high flow rate so that the last bit of liquid flows out of the container.

b) The outlet opening should be protected against insects and other possible sources of dirt and contamination.

c) It should feature a tamper-evident tear-off seal which ensures that it is readily ascertainable whether the container has been opened or not. This is important in view of product liability.

d) A tax stamp or tax seal should be capable of being affixed directly on top of the tamper-evident tear-off seal as needed.

e) The tap should be capable of being heat-sealed directly with the film of the inner container without a coupling piece having to be used.

f) The shape of the tap body should enable it to be manufactured from plastic via injection molding and easily demolded.

As to the present state of the art, various types of taps are in use for liquid bulk containers. However, most of these taps pose considerable shortcomings.

Taps which are opened and closed by turning an actuating element are not suitable for bag-in-box containers as the tap affixed to the plastic film of the flexible inner container of bag-in-box packages does not offer sufficient hold. To open a tap of this type, the tap or the coupling piece has to be held using one hand, while operating the actuating element with the other, meaning there is no hand free to hold the vessel to be filled. Turn-type taps are the subject of printed patent specifications EP 0467 530 (published on 22 Jan. 1992), EP 0 117 619 (published on 5 Sep. 1984), WO 94/29214 (published on 22 Dec. 1994), WO 90/05696 (published on 31 May 1990) and published patent application DE 39 10 425 (laid open for public inspection on 18 Oct. 1990), for example.

Taps which can be opened and held using one hand are more suitable for bag-in-box containers. The second hand can be used for holding the glass or vessel to be filled.

The opening of the inner container can be closed off using a gasket sheet or a plug so that no oxygen can seep into the container before using it for the first time. The gasket sheet or plug is removed when using the container for the first time. There are taps which, in addition to the valve device, feature a device for punching the gasket sheet or removing the plug from the container opening when using the container for the first time.

There are taps in which the axes of the valve device and the punching device are positioned at a right angle to one another. The valve device is normally comprised of a valve component which, along with the valve seat, forms the valve per se, in addition to a valve stem. The punching device comprises a punching component which in turn is subdivided into a head and a stem. The head features a minimum of a sharp point or edge for punching through the gasket sheet in the container opening. It can also be shaped as a plug which closes off the container opening. The stems of the valve device and the punching device are operatively connected to one another. This means that when actuating the valve device, the punching device is actuated at the same time, or vice versa. Part of the stem of the valve device or the punching device can be shaped as a wedge in order to transmit the actuating motion. Taps of this type are the subject of printed patent specification EP 0 553 956 (published on 4 Aug. 1993) and published patent application DE 32 12 232 (laid open for public inspection on 7 Oct. 1982). In the tap described in published patent application DE 32 12 232, there is a deformable body for transmitting the motion between the stem of the valve device and the stem of the punching component.

In order to achieve reliable force transmission between the stems of the valve device and the punching device (positioned vertically to one another) complicated constructs comprised of numerous individual components are required, this in turn leading to high manufacturing costs, in addition to frequenting providing for insufficient tightness. Consequently in published patent application DE 32 12 232, a tap with a valve device and a closure device is suggested for the container opening in which the valve part and the plug of the closure device are arranged in tandem in a coaxial manner. When the elastic actuating knob is actuated, the valve part is slid out of the valve seat, thus causing the tap outlet to be opened. At the same time the valve part presses the plug forwards, thus causing the container outlet to be opened. The elastic actuating knob can be featured as a constituent of the tap body. It acts on the valve part via a valve stem.

When the opening of a liquid bulk container is closed off by a gasket sheet or a plug, the entry of oxygen can be prevented for the most part until the container is used for the first time. Nevertheless, the liquid may oxidize to a certain degree if it has not been filled in an airfree manner. However, a gasket sheet or a plug can be dispensed with if the tap itself provides for sufficient tightness. Consequently, simple-design taps without a punching device are described in various printed patent specifications.

For example, printed patent specification GB 1 471 039 (published on 21 Apr. 1977) describes a tap featuring a tube-like body. One end of this body forms the outlet, the other end is closed off via an elastic membrane. The membrane can be integrated in the body. In addition, the membrane is connected to a valve component. When in the closed position, this valve component is seated in a valve seat molded at the outlet. The membrane can be connected to the valve component via a stem, for example. When the membrane is pressed inwards, the valve component is slid out of the seat and the outlet opened. The inlet opening is located between the valve seat and the membrane in the wall of the tube-shaped body. A hollow-cylinder-shaped component can be molded on the outside of the body at the inlet opening, the component being chamfered at its free end and featuring ribs on its outer surface.

A similar tap is described in printed patent specification GB 2 283 077 (published on 26 Apr. 1995). This tap consists of two parts. The first part features a hollow-cylinder-shaped section. A laterally protruding flange is molded at one end of this hollow-cylinder-shaped section, the flange being heat-sealed to the inner, flexible container. At the same end the hollow-cylinder-shaped section features an edge projecting towards the inside whose inner surface forms the valve seat. The wall of the hollow-cylinder-shaped section features an opening. The second part of the tap is subdivided into a collar-like and a tube-shaped section. The collar-like section is fitted onto the hollow-cylinder-shaped section of the first part. The tube-shaped section lies both within the collar-like section of the second part as well as within the hollow-cylinder-shaped section of the first part. It serves as a valve element. The collar-like section and the tube-shaped section are connected to one another via an elastic, round plastic disc. Applying pressure to this plastic disc from the outside causes the valve component to be lifted out of the valve seat and, thus, the valve to open. When no pressure is applied, the plastic disc is flexed back into its basic shape, in the process causing the valve component to be pulled back into the valve seat.

Printed patent specification EP 0 350 243 (published on 10 Jan. 1990) describes a tap which features an essentially hollow-cylinder-shaped housing. The tap housing features an inlet opening at its rear end, i.e. the end nearest the container. A tube-shaped valve component is located inside the housing, the component capable of being slid axially. This valve component features an outlet opening in its front end section and an inlet opening at its rear end. The inner surface of the housing wall features, at minimum, a spiral-shaped groove into which a pin projecting laterally from the valve component engages. Thanks to this design, the axial movement of the valve component causes it to rotate. The valve component can be moved from an open position in which the outlet opening of the valve component is open into a closed position in which the outlet opening is closed.

Printed patent specification GB 2 247 882 (published on 18 Mar. 1992) describes a tap which is comprised of a mounting member, a tap housing and a valve housing fitted on top of the tap housing. The mounting member consists of a hollow-cylinder-shaped body, with a flat flange projecting laterally along the inner edge of the body. The tap housing is screwed onto the body of the mounting member. The cup-shaped valve housing is fitted onto the tap housing. A conical valve component is molded on the inner surface of the outer wall of the valve housing. The outer end of the tap housing is closed off by the valve housing being pressed in the direction of the mounting member and the valve component being consequently slid into the open end of the tap housing. The wall of the valve component features an outlet opening.

A similar tap is described in printed patent specification WO 95/22504 (published on 24 Aug. 1995). This tap features a housing with an inlet and an outlet opening. The housing features a valve component inside. It can be moved along the longitudinal axis of the housing from a first, front position, in which it prevents the flow of liquid through the tap, to a second, rear position, in which it allows the flow of liquid through the tap. The valve seat is formed by a section of the housing wall.

Finally a tap is proposed in printed patent specification EP 0 432 070 (published on 12 Jun. 1991) which is essentially comprised of a body for mounting in the outlet opening of the container and a spring-loaded piston for releasing the liquid. The piston acts on an elastic sealing membrane which is connected to the body. The body comprises the tap itself and a shank for mounting it in the outlet opening of the container. The shank features a groove which acts in conjunction with a ring-shaped projection of the outlet opening. In addition, the body features a laterally projecting bearing ring. The piston features laterally protruding handling projections in its one upper part. In addition, the tap features a tear-off tax device containing a ring which locks the piston in place.

In summary it can be said that there are basically two possibilities for securing a tap to the plastic film of the inner container of a bag-in-box:

First possibility: The body of the tap is heat-sealed directly with the plastic film. A laterally projecting flange is molded onto the body for this purpose. To date the body of the tap has been made from a relatively hard material, consequently the flange is hard as well. This renders heat-sealing the flange with the thin, flexible plastic film of the inner container difficult. In addition, in view of the fact that the flange is made of a hard material, the plastic film tends to tear along the outer edge of the flange. Applying a tap means having to be able to grip the tap at the front with a tool. In addition, the tool used to heat-seal the rear end of the tap with the plastic film of the container has to be capable of being slid over the front section of the tap. This cannot be done unless the front tap section is narrower than the rear tap end section. The handling projections protrude laterally from the actual tap body, thus they determine the width of the tap. The rear tap end section, particularly the flange, of a tap with handling projections is consequently wider than one without any.

Second possibility: A ring-shaped coupling piece is heat-sealed to the plastic film of the inner container. The tap is subsequently inserted into the heat-sealed-on coupling piece. To this end the tap body features a shank which fits into the coupling piece. The coupling piece is made of relatively soft plastic, in contrast to the tap body, and can be accordingly better heat-sealed with the plastic film of the inner container than a hard flange. However, additional material is required for the manufacture of the coupling piece, thus increasing the manufacturing costs. The tool used to insert the tap into the coupling piece also has to be capable of being slid over the front section of the tap. The front tap section therefore has to be narrower than the rear tap section in this case as well. The handling projections determine the overall width of the front tap section here, too. The rear tap section, which can also be in the form of a laterally projecting bearing ring, for example, has to consequently be wider on a tap with handling projections than on one without handling projections. This applies to the coupling piece as well. However, the taps and the coupling pieces may not be overly large otherwise the associated material, storage and transportation costs will be excessively high.

All of the known taps for bag-in-box containers feature an overly complicated design or satisfy the major properties of an optimal tap only in part. Overly large quantities of plastic are required for their manufacture in some cases, thus making their manufacture as well as their transportation and storage expensive. In addition, most known taps offer only insufficient tightness, thus impairing the shelf life of liquids stored in bag-in-box containers.

SUMMARY OF THE INVENTION

The object of the invention at hand is to create a tap for liquid bulk containers, in particular for bag-in-box containers consisting of a flexible inner container and a rigid outer container, which can be used more universally and which features a simpler design, in addition to being made of a smaller quantity of plastic than known taps of a similar type. The tap is to roll all the major properties of an optimal tap into one. The object of the invention is also to create a tap which is as gastight and user-friendly as possible. In addition, the tap should be capable of being heat-sealed directly to the plastic film of the inner container without a coupling piece being required.

This object is achieved by means of the distinctive characteristics of. Advantageous features offered by the invention are the subject of the dependent claims.

The proposed tap features a hollow, elastic body with an inlet and an outlet opening. In addition, it comprises a valve element which closes off the outlet opening in its basic position.

In the first embodiment of the tap proposed the lift causing the valve element to be pulled out of the outlet opening is achieved by deforming the body by applying pressure laterally. The pressure is thus applied at a right angle to the direction of movement of the valve element. In the process, the size of the body is decreased in the direction of the application of pressure, at the same time increasing in the direction of movement of the valve element. A protective cap can be fitted on top of the body in order to protect the tap body against unintentional deformation, the cap also serving as the substrate for a tax seal or a tax stamp. The proposed tap also features a tamper-evident tear-off seal.

In the second embodiment of the proposed tap, the lift causing the valve element to be pressed out of the outlet opening is achieved by deforming the body from above and below. The pressure is thus applied coaxially to the direction of movement of the valve element. The invention is explained below on the basis of the examples shown in the drawings, for example. The following is depicted in the drawings:

BRIEF DESCRIPTION OF THE DRAWING

FIG. 6b Cross section C—C of a tap according to FIG. 6a.

DETAILED DESCRIPTION OF THE INVENTION

Figure 1A:
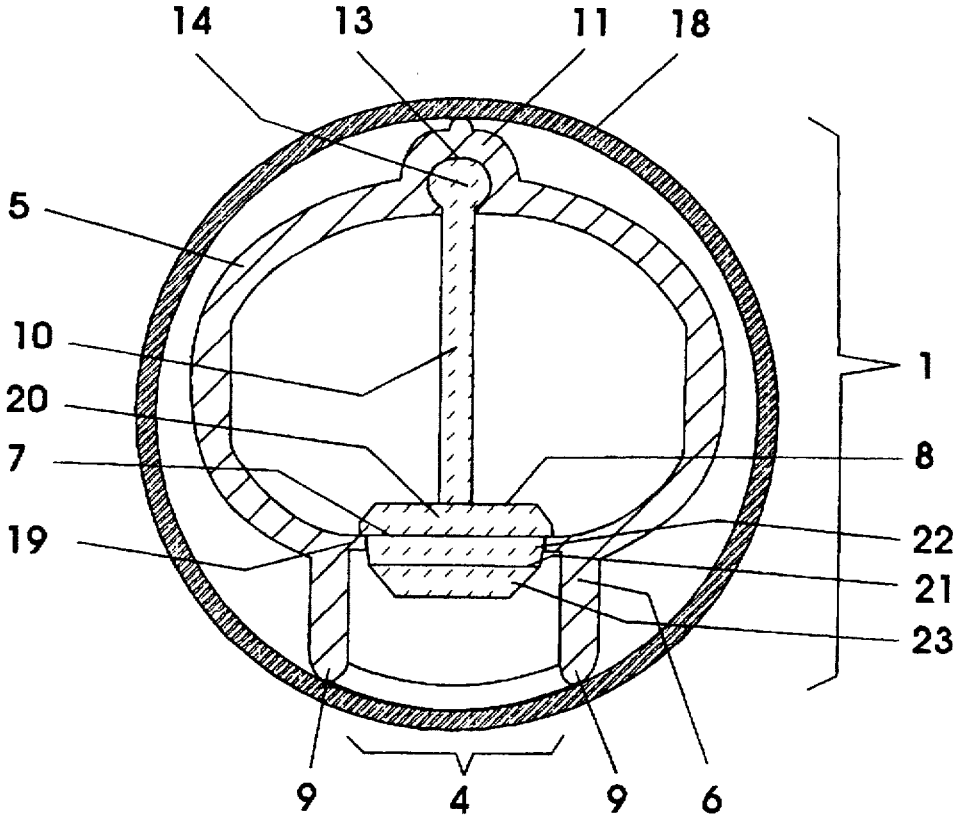
FIG. 1*a* A cross section of a proposed tap of the first embodiment in a closed state, with the cap fitted on top.
Figure 1B:
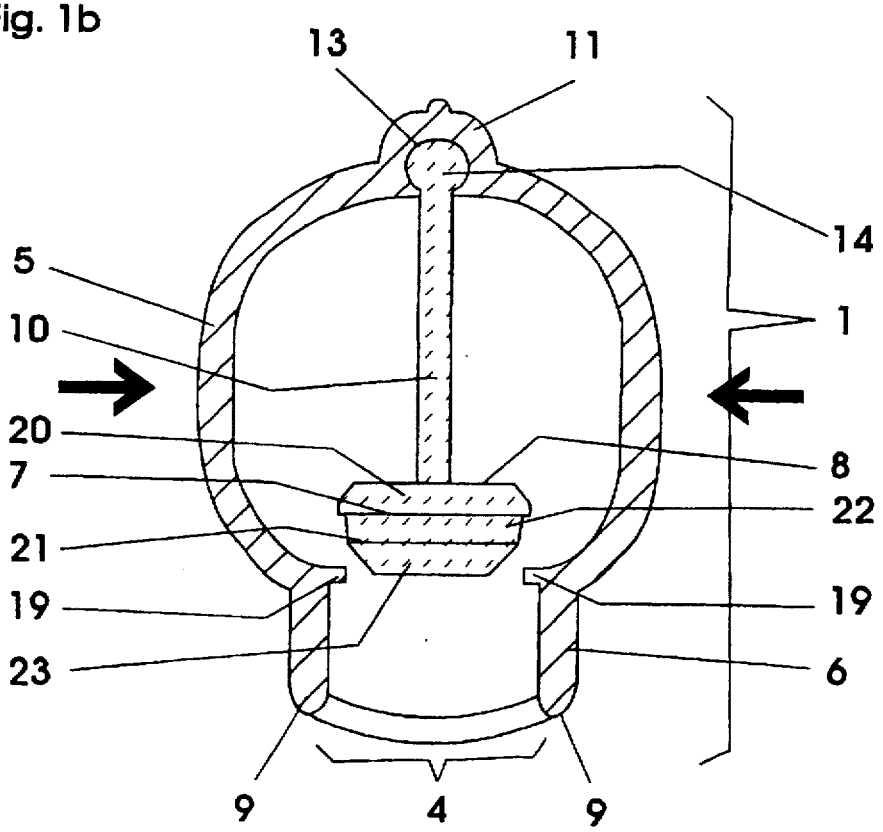
FIG. 1*b* A cross section of the tap according to FIG. 1*a* in an open state, without the cap.
Figure 2A:
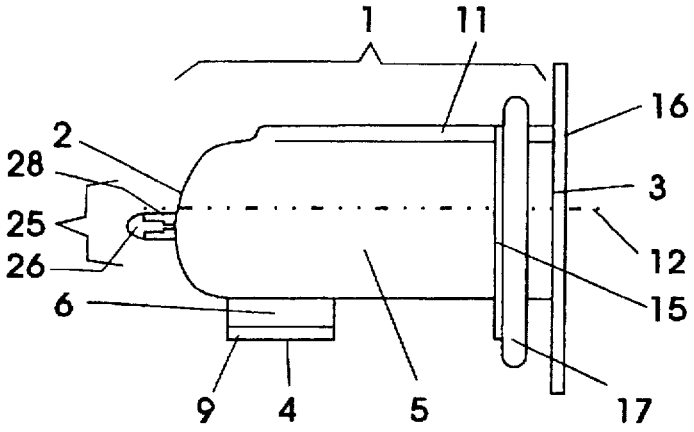
FIG. 2*a* A side view of a proposed tap of the first embodiment, without the cap.
Figure 2D:
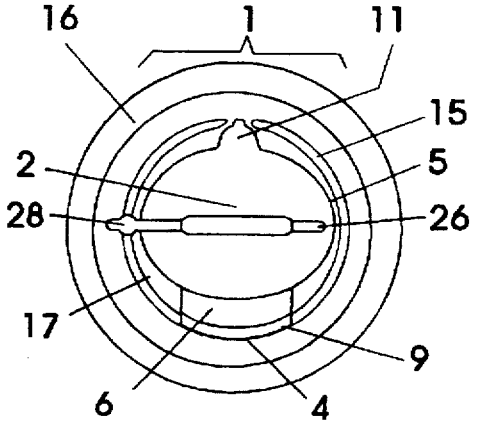
FIG. 2*d* A front view of the tap according to FIG. 2*a;*
Figure 2B:
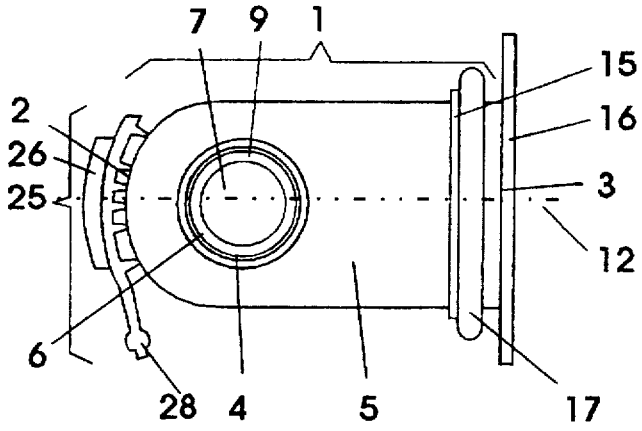
FIG. 2*b* A view from below of the tap according to FIG. 2*a;*
Figure 2E:
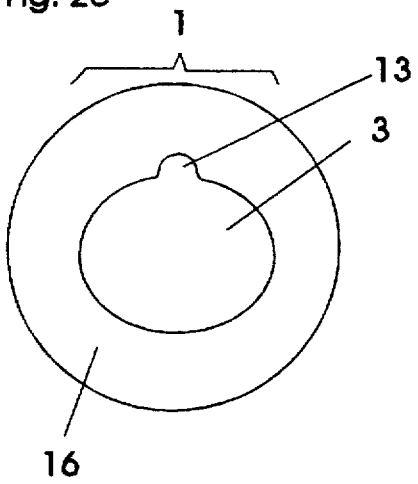
FIG. 2*e* A rear view of the tap according to FIG. 2*a;*
Figure 2C:
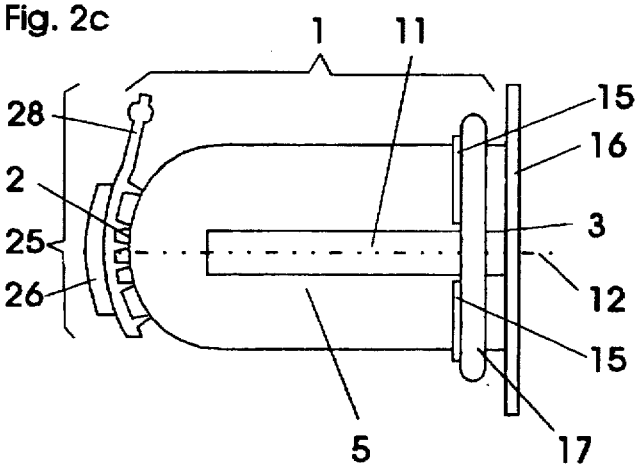
FIG. 2*c* A view from above of the tap according to FIG. 2*a;*

In the example depicted in the drawings, the proposed tap of the first embodiment comprises an elongated hollow body (1). In its basic or quiescent condition this body (1) features an essentially oval or elliptical cross section (cf. FIGS. 1a to 2c). It is made of a flexible, elastic plastic.

The front side (2) of the body (1), i.e. the side furthest from the liquid bulk container, is closed and curved in a concave manner towards the outside (cf. FIGS. 2a to 2d). The rear side (3) of the body (1), the side nearest the liquid bulk container, is open (cf. FIG. 2e). It forms the inlet opening of the tap. The outlet opening (4) is located in a slightly curved section of the body wall (5) (cf. bottom area of drawings), near the front (2) of the body (cf. FIGS. 1a, 1b and 2b). It is circular when the body (1) is not deformed, i.e. is in its quiescent state. On the outside of the body wall (5) the outlet opening (4) is enclosed by a hollow-cylinder-shaped collar (6). The internal diameter of the collar (6) features the same diameter as the outlet opening (4). On the inner edge of the outlet opening (4) is a perimetric ring flange (19) projecting in the direction of the middle of the opening, the ring flange serving as a limit stop for the valve element (7) and thus forming the valve seat. The valve element (7) is subdivided into a wide upper part (20) and a narrow lower part (21). Both parts (20, 21) feature a round cross section. The diameter of the upper part (20) is somewhat larger than the internal diameter of the perimetric ring flange (19). The diameter of the lower part (21) corresponds to the internal diameter of the ring flange (19) or is somewhat smaller than it. A step is thus formed between the two parts (20, 21) which fits against the ring flange (19) when the tap is closed. The lower section of the upper part (20) is cylindrically shaped, the upper section being conically shaped. The lower part (21) of the valve element (7) is subdivided into a lower and an upper section. The upper section (22) is slightly conical, the lower section (23) being very conical. The outer side of the lower part (21) has a smaller diameter than the inner side (as shown in the drawing (FIGS. 1a and 1b) the "outer side" is at the bottom and the "inner side" is at the top).

The valve element (7) is connected to the wall (5) of the tap body (1) via a rod-shaped stem (10). The stem (10) projects from the center of the inner side (8) of the valve element (7) at a right angle. Its one end, i.e. the end opposite the valve element (7), is secured to the wall (5) of the body (1) at a position located across from the center of the outlet opening (4) (cf. FIGS. 1a and 1b). The mounting position of the stem (10) is consequently also located in a slightly curved section of the body wall (5) (cf. top area of drawings). Both the valve element (7) and the stem (10) are made of plastic. The valve element (7) and the stem (10) are preferably manufactured as a continuous, single piece. The length of the stem (10) is selected so that the valve element (7) is pressed slightly into the valve seat of the outlet opening (4) when the body (1) is in its quiescent state. The body wall (5) features a lengthwise rib (11) on the outside (shown in the upper area of the drawings) for the purpose of securing the stem (10), the rib running parallel to the longitudinal axis (12) of the body (1). The rear end of the lengthwise rib (11) is located at the rear (3) of the body (1). The front end section of the lengthwise rib (11) is located across from the center of the outlet opening (4) (cf. FIGS. 1a to 2a, 2c and 2d). On its inside the lengthwise rib (11) features a lengthwise groove (13), the groove being open towards the inner area of the body (1) and groove preferably featuring a round cross section. This lengthwise groove (13) extends along the entire length of the lengthwise rib (11). The front end section of the lengthwise rib (13) is undercut (cf. FIGS. 1a and 1b), this serving to secure the stem (10). The lengthwise rib (11) and the lengthwise groove (13) extend all the way to the rear (3) of the body (1), thus making for easy demolding during injection molding.

At its one end, i.e. the end opposite the valve element (7), the stem (10) features a spherical- or cylindrical-shaped thickening (14). The longitudinal axis of a cylindrical-shaped thickening (14) is positioned at a right angle to the longitudinal axis of the stem (10). The diameter of the thickening (14) is slightly larger than the diameter of the lengthwise groove (13). The stem (10) is pressed along with the valve element (14) through the outlet opening (4) from the outside, followed by the thickening (14) being pressed into the front end section of the lengthwise groove (13). The conical shape of the upper section of the upper valve element part (7) facilitates the valve element (14) being pressed through the outlet opening (4).

If the strongly curved section of the body wall (5) are pressed together using two fingers (cf. side areas in the drawings) the elastic body (1) deforms to such an extent that its size in the direction of the pressure acting on it decreases, whereas its size at a right angle to the direction of the pressure acting on it increases. This creates a lift which pulls the valve stem (10) away from the outlet opening (4) of the tap. This causes the valve element (7) to be lifted out of its seat and the outlet opening (4) to be opened. When pressure ceases to be applied to the body (1), the elastic body (1) returns to its original shape. The valve element (7) is pressed back into the valve seat by the valve stem (10). The lower, strongly conically shaped section (23) of the valve element (7) ensures that the valve element (7) easily finds its way back into the outlet opening (4).

In addition, there is a flat, laterally protruding flange (16) molded to the rear (3) of the body (1). This flange (16) enables the tap to be directly heat-sealed with the plastic film of the flexible inner container of a bag-in-box. A perimetric, ring-shaped rib (17) can also be additionally molded on the outside of the body wall (5) near the rear (3). A perimetric groove is thus formed between the flange (16) and the rib (17) in which the wall of the rigid outer container of a bag-in-box can be fitted.

As an alternative to the flange (16), the rear section of the body (1) can be formed as an insertion shank or slip-on end which can be joined to a coupling piece (not shown).

Figure 3A:
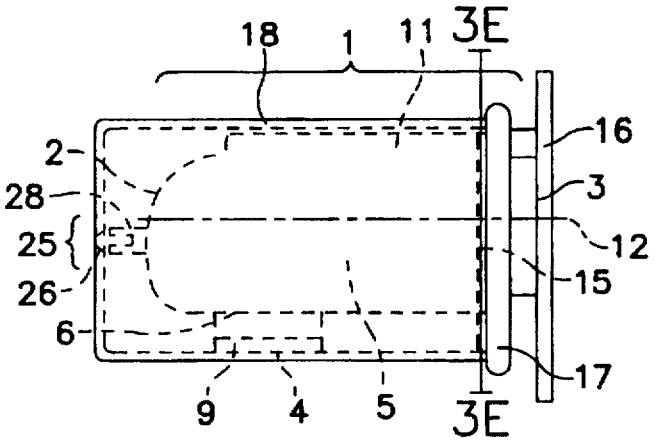
FIG. 3*a* A side view of a proposed tap of the first embodiment with the cap fitted in place on top.
Figure 3D:
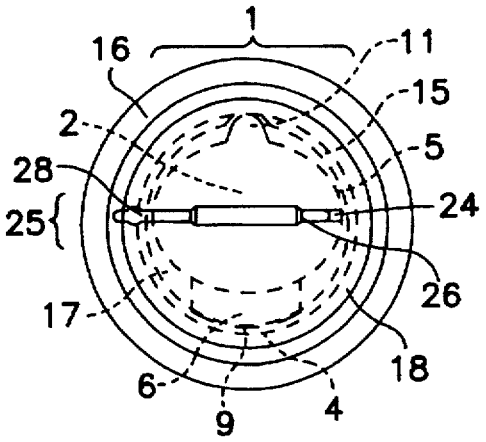
FIG. 3*d* A front view of the tap according to FIG. 3*a;*
Figure 3B:
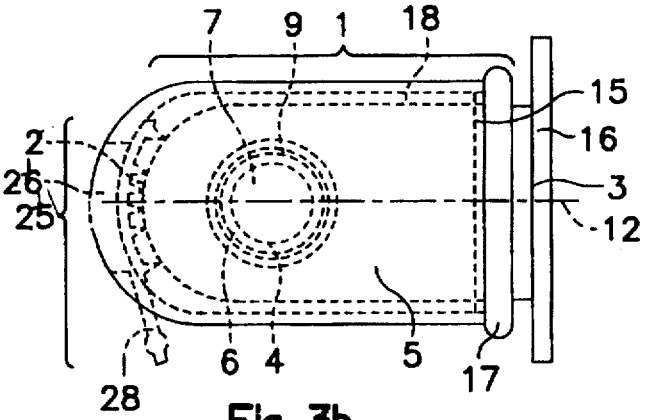
FIG. 3*b* A view from below of the tap according to FIG. 3*a;*
Figure 3E:
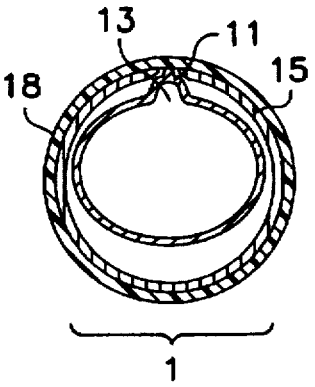
FIG. 3*e* Section A—A of the tap according to FIG. 3*a;*
Figure 3C:
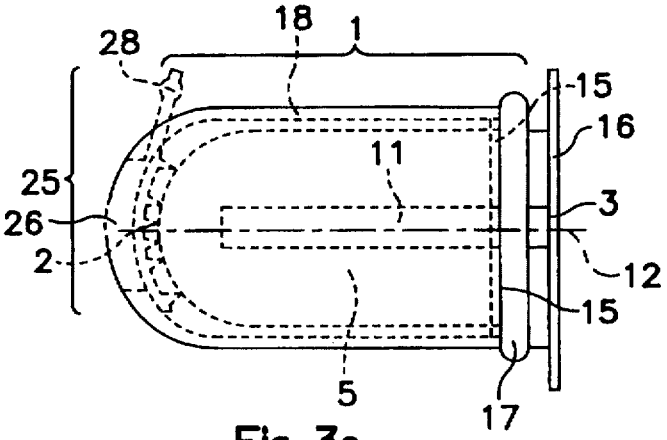
FIG. 3*c* A view from above of the tap according to FIG. 3*a;*
Figure 4A:
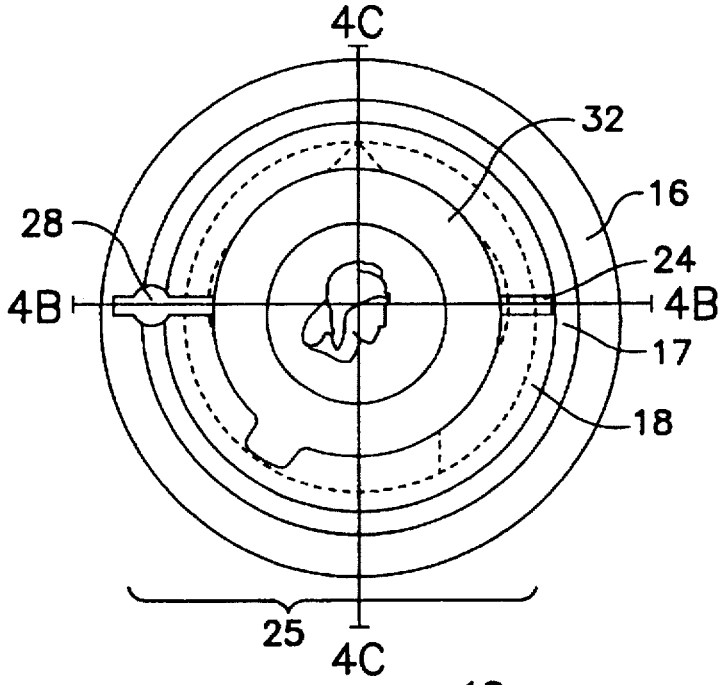
FIG. 4*a* A front view of a proposed tap of the first embodiment with the cap fitted on top and a tax seal affixed on top of the cap.
Figure 4B:
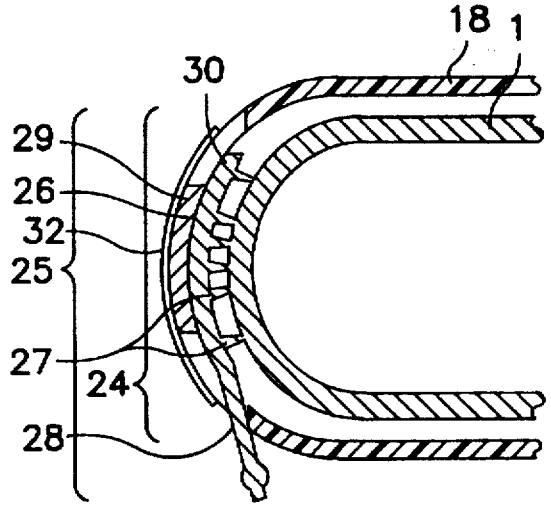
FIG. 4*b* A longitudinal section the front section of the body of a tap of the first embodiment with the cap fitted on top and a tax seal affixed on top of the cap.
Figure 4C:
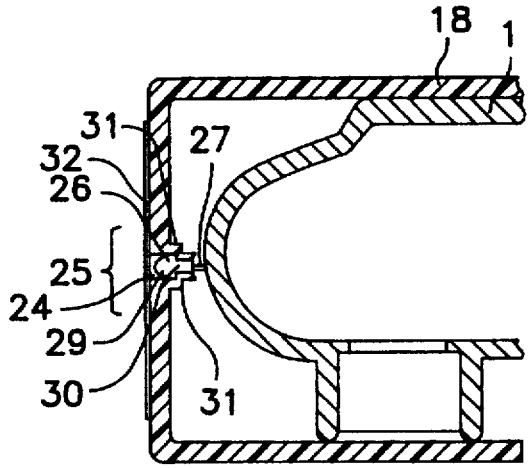
FIG. 4*c* Longitudinal section B—B of the front section of a tap body according to FIG. 4*b;*
Figure 5:
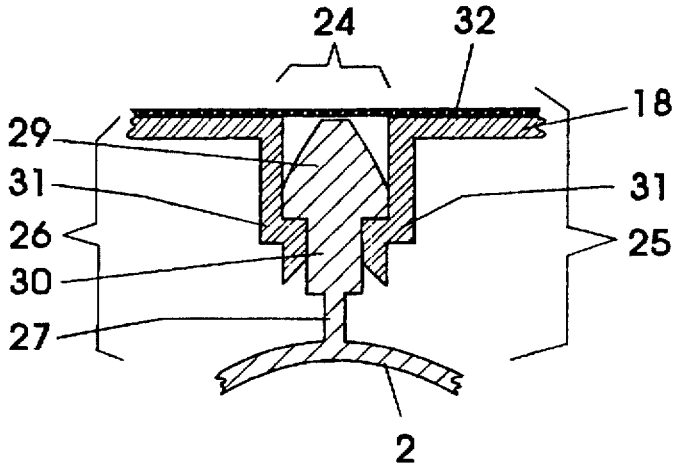
FIG. 5 A section of the tamper-evident tear-off seal of a tap body according to FIG. 4c.

A cap (18) is provided which can be fitted on the tap from the front (cf. FIGS. 3a to 3d). This cap (18) is preferably hollow-cylinder-shaped, with its front side being closed except for a narrow crosswise slit (24). The cap is made of rigid plastic. Its internal diameter corresponds to the height of the tap body (1) or is slightly smaller than it. Its internal diameter is also larger than the width of the tap body (1). In addition, the cap (18) is at least as long as the body (1). Its front side is preferably curved in convex fashion. When fitted on the tap, the cap (18) touches the body (1) at the lengthwise rib (11) and the outer side of the collar (6). In addition, the rear edge of the cap (18) fits against the ring-shaped rib (17). The outer side of the collar (6) is preferably curved in such a manner that it completely fits against the cap (18). To additionally improve tightness, the collar wall is tapered on the outside. As a consequence, a type of sealing lip (9) is formed which fits snugly with the cap (18), forming a seal with it. A narrow, essentially ring-shaped projection (15) is molded at the front of the ring-shaped rib (17) (cf. FIGS. 2*a* to 3*e*). The outer diameter of this projection (15) corresponds to the internal diameter of the cap (18) at its rear or is slightly smaller than it. The projection (15) is interrupted at the position at which it intersects with the lengthwise rib (11). When the cap (18) is fitted onto the tap body (1), its inner surface fits against the projection (15) (cf. FIG. 3*e*).

The cap (18) serves the following functions:

When the tap is pulled out of the liquid bulk container when opening the container, pressure might inadvertently be applied to the sides of the tap, causing liquid to unintentionally flow out of the container. The rigid cap (18) prevents the tap body (1) from being pressed together. It stabilizes the body (1) along its diameter. In addition, the soft tap body (1) is pressed together slightly by the cap (18), the cap fitting against the lengthwise rib (11) of the body (1) and the sealing lip (9) of the collar (6). The resulting slight deformation of the body (1) causes the ring flange (19) at the outlet opening (4) to be pressed against the valve element (7). The result is improved sealing action between the valve element (7) and the ring flange (19).

Since the tap body (1) is made of flexible plastic, it also runs the risk of being deformed when forces act upon it or when it is subjected to large temperature fluctuations. The risk of deformation is greatest when the tap has not yet been mounted to the liquid bulk container, i.e. during storage or transportation. Deformation can be reliably prevented by protecting the tap with a rigid cap (18).

Last but not least, the cap (18) provides protection against dirt. The tap cannot be actuated without removing the cap (18). The cap is advantageously placed back on the tap afterwards. This prevents the tap from being soiled or contaminated as the result of dust or dirt buildup, mildew, insects, etc. Only slight pressure should be applied when placing the cap (18) back on the tap so that the cap can be easily removed the next time.

The round cross section of the cap (18) provides for maximum stability, in addition to being capable of being placed on the tap body (1) in any rotated position.

The tamper-evident tear-off seal (25) of the proposed tap comprises a ridge (26), which is located on the front side (2) of the body (1) (cf. FIGS. 2*a* to 2*d* and 3*a* to 4*c*). The ridge (26) is curved slightly and extends across the front side (2) of the body. It is connected to the body (1) exclusively via several fine prongs (27). These prongs (27) are torn from the body when the seal is broken.

A tab (28) is molded at the one side of the ridge (26). The ridge (26) can be severed from the body (1) by pulling the laterally protruding tab (28) away from the cap or tap body, in the process causing the fine prongs (27) to tear in succession. The ridge (26) is subdivided into an upper section (29) and a lower section (30). The upper section (29) serves as a barb which is capable of engaging in the crosswise slit (24) on the front of the cap (18). To this end it features one or several areas which are wider than the lower ridge section (30) and as a consequence project beyond the lower ridge section (30) on both sides. These laterally projecting areas act as barbs. A lengthwise rib (31) protrudes into the crosswise slit (24) at either rear edge (underside) of the crosswise slit (24) of the cap (18). The space between these lengthwise ribs (31) is at least as large as the width of the lower ridge section (30), however it is smaller than the width of the projecting areas of the upper ridge section (29). When the cap (18) is placed on the tap body (1), the outer surface of the upper ridge section (29) fits against the lengthwise ribs (31). As a consequence, the cap (18) cannot be removed before the ridge (26) has been torn off. The height of the ridge (26) is selected so that the upper ridge section (29) does not project beyond the outer surface of the cap (18), meaning it is recessed.

As a consequence, the possibility is offered of affixing tax seal or tax stamp (32) to the front of the cap (18). The tax seal or tax stamp (32) is also destroyed when the ridge (26) is ripped off.

Figure 6A:
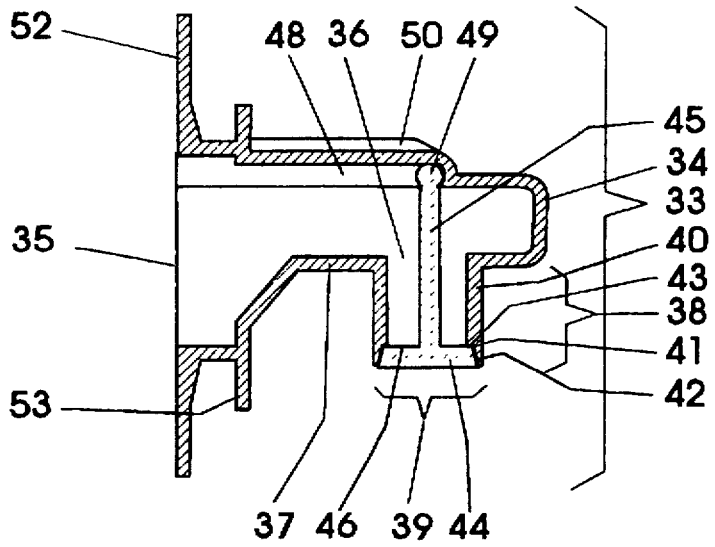
FIG. 6a A longitudinal section of a tap of the second embodiment.
Figure 6B:
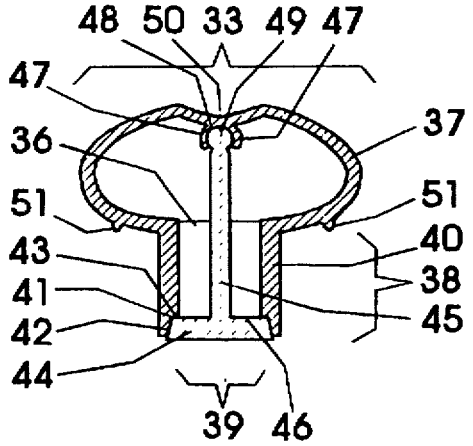

In the example shown in the drawings, the proposed tap of the second embodiment comprises an elongated, hollow body (33). This body (33) features an essentially oval or elliptical cross section. It is slightly flattened. This means that its width corresponds to approximately 200% of its height (cf. FIG. 6*b*). The body (33) is made of soft, elastic plastic. Its front side (34), i.e. the side furthest from the liquid bulk container, is closed. By contrast, its rear side (35), the side nearest the liquid bulk container, is open (cf. FIG. 6*a*). This side forms the inlet opening of the tap. A circular opening (36) is located in a slightly curved section of the body wall (37) (shown in the lower area of the drawings) near the front (34) of the tap body. A hollow-cylinder-shaped collar (38) is molded to the outside of the body wall (37) in the vicinity of this opening (36). The lower, open side of this collar (38) forms the outlet opening (39) of the tap. On the inner surface of the collar wall (40) there is a ring-shaped recess (41) bordering on the lower collar wall end. The lateral contact area (42) of this recess (41) is preferably sloped in relation to the center longitudinal axis of the collar (38). The top contact area (43) and the lateral contact area (42) of the recess (41) form the valve seat. The valve element (44) is conical in shape, its diameter corresponding to the diameter of the recess (41) and the angle of slope of its lateral surface corresponding to the angle of slope of the lateral contact area (42) of the recess (41). The valve element (44) is connected to the wall (37) of the body (33) via a rod-shaped stem (45). This stem (45) extends at a right angle from the center of the upper face (46) of the valve element (44). Its one end, i.e. the end opposite the valve element (44), is connected to the inner surface of the body wall (37) at a position located across from the center of the outlet opening (39) (cf. FIGS. 6*a* and 6*b*). Both the valve element (44) and the stem (45) are made of plastic. The length of the stem (45) is selected in such a manner so that the edge area of the upper face (46) of the valve element (44) fits against the top contact area (43) of the recess (41) when the body (33) is in its quiescent state. The body wall (37) features two parallel lengthwise ribs (47) on its inner surface (cf. top of drawings) for the purpose of securing the stem (45). These lengthwise ribs (47) feature a lunulate-shaped cross section. Their concave sides face one another so that an undercut lengthwise groove (48) featuring a cross section shaped like the sector of a circle is formed between them. The one end of the stem (45), i.e. the end opposite the valve element (44), features a spherical- or cylindrical-shaped thickening (49). The longitudinal axis of a cylindrical-shaped thickening (49) runs at a right angle to the longitudinal axis of the stem (45). The diameter of the thickening (49) is slightly larger than the diameter of the lengthwise groove (48). The stem (45) is mounted by being inserted through the outlet opening (39) from the outside, followed by the thickening (49) being pressed into the front end section of the lengthwise groove (48).

The valve is opened by pressing the thumb of one hand against the upper side and the index finger and the middle finger of the same hand against the underside of the tap body (33). This causes the elastic body (33) to be deformed to such a degree, that its size in the direction of the pressure acting upon it is decreased. This creates a lift which causes the valve stem (45) to be thrust in the direction of the outlet opening (39) and the valve element (44) to be pressed out of the valve seat, thus causing the outlet opening (39) to open as a result. When pressure ceases to be applied to the body (33), the elastic body (33) returns to its original shape. The valve element (44) is pulled back into the valve seat by the valve stem (45). The conical shape of the valve element (44) and the recess (41) ensure that the valve element (44) easily finds its way back into the outlet opening (41).

The body (33) can feature a lengthwise indentation (50) on its upper side so that the thumb can better grip the body (33). In addition, a lengthwise rib (51) can be molded on its underside on either side of the collar (38), the lengthwise ribs (51) offering a better grip for the index and middle fingers.

In addition, a flat, laterally protruding flange (52) is molded to the rear (35) of the body (33). This flange (52) is heat-sealed to the plastic film of the inner container of a bag-in-box. A perimetric ring-shaped ring (53) can be additionally molded on the outside of the body wall (37) near the rear (35) of the body. A perimetric groove is thus formed between the flange (52) and the rib (53) in which the wall of the rigid outer container of a bag-in-box can be fitted (not shown).

As an alternative to the flange (52), the rearmost section of the body (33) can be formed as a shank which can be inserted into a conventional coupling piece (not shown).

A tool or a die featuring a main core and a secondary core is used for manufacturing the tap body (33) via injection molding (not shown). The main core serves to shape the elongated inner area section and the rear, open side (35) of the body (33), the secondary core serving to shape the inner area of the collar (38) and the outlet opening (39). During deforming, the main core is pulled out of the rear, open body side (35) and the secondary core out of the outlet opening (39). The shape of the body (33) and the design of the tool/die enable the body (33) to be easily deformed.

The proposed tap is primarily intended for bag-in-box containers. Of course, it can also be used for containers made of rigid plastic.

The proposed tap features essential advantages over known taps for liquid bulk containers comprised of a flexible sack-like inner container and a rigid outer container:

Since its body (1, 33) is made of low-density flexible plastic, the flange (16, 52) which is heat-sealed with the plastic film of the inner container can be directly molded to the body. The proposed tap is thus suitable for being heat-sealed directly with the plastic film of the inner container without coupling pieces having to be used.

In addition, it is comprised of only three or two simple components and consequently features a considerably less complicated design than known taps. These simple components are suitable for manufacturing using multi-impression molds. In contrast to known taps, the proposed tap also features a single sealing point, consequently it possesses characteristics conducive to optimal sealing action as compared with known taps.

The proposed tap does not require any tap handling projections, consequently it can be designed smaller. This means that a smaller amount of plastic is required for its manufacture than for the manufacture of known taps. In addition, its spatial requirements are smaller, which is advantageous with respect to transportation and storage.

I claim:

1. A plastic dispense tap for a flexible liquid bulk container, said plastic dispense cap provided to close and open said flexible container, said plastic dispense cap comprising:

1) a hollow body having an elastic wall with inner and outer surfaces, said body having:
   an inlet opening and an outlet opening, and
   a lengthwise groove formed along the inner surface of the wall of the body across from the outlet opening, and extending from the side nearest to the liquid bulk container to the side farthest from the liquid bulk container; and 2) a valve element comprising:
   a valve part provided to close said outlet opening when said body is in a quiescent state, and
   a two-ended rod shaped stem connected to said valve part on one of its ends, and connected to said inner wall of said body on its other end across from said outlet opening, having:
      a thickening of the stem of the valve element such that said stem is insertable in said lengthwise groove;
      wherein said elastic body has a barrel-shaped cross section, and said wall is deformable by way of applied pressure for the purpose of generating a movement of said valve stem; and
      wherein said lengthwise groove allows insertion of said valve element from said side farthest from the liquid bulk container.

2. The plastic tap of claim 1, wherein the valve element is shaped such that it can be inserted into said lengthwise groove through said outlet opening.

3. The plastic tap of one of claims 1 and 2, further comprising a tamper-evident tear-off seal molded to said body.

4. The plastic tap of claim 3, further comprising a cylinder-shaped cap made of rigid plastic which is removably attached to said body of said tap, wherein said tear-off seal is inserted through a crosswise slit in said cap.

5. The plastic tap of claim 4 wherein a tax seal is affixed to said tear-off seal.

* * * * *

UNITED STATES PATENT AND TRADE MARK OFFICE

CERTIFICATE OF CORRECTION

PATENT NO. : 5,785,212
DATED : July 28, 1998
INVENTOR(S) : Arthur Steiger

It is certified that error appears in the above-identified patent and that said Letters Patent is hereby corrected as shown below:

On the title page;

item [56] References Cited

FOREIGN PATENT DOCUMENTS 39 10425 10/1990 Germany

Signed and Sealed this

Seventeenth Day of November, 1998

Bruce Lehman

*Attest:*

BRUCE LEHMAN

*Attesting Officer*

*Commissioner of Patents and Trademarks*